United States Patent [19]

Niimi et al.

[11] 4,213,366

[45] Jul. 22, 1980

[54] ELECTRONIC MUSICAL INSTRUMENT OF WAVE MEMORY READING TYPE

[75] Inventors: Koji Niimi; Mitsumi Katoh; Masatada Wachi, all of Hamamatsu, Japan

[73] Assignee: Nippon Gakki Seizo Kabushiki Kaisha, Japan

[21] Appl. No.: 956,876

[22] Filed: Nov. 1, 1978

[30] Foreign Application Priority Data

Nov. 8, 1977 [JP] Japan ..... 52-133119

[51] Int. Cl.[2] ..... G10H 1/00; G10H 5/00

[52] U.S. Cl. ..... 84/1.01; 84/1.19; 84/1.22; 84/DIG. 2

[58] Field of Search ..... 84/1.01, 1.03, 1.19, 84/1.22, DIG. 2

[56] References Cited

U.S. PATENT DOCUMENTS

| | | | |
|---|---|---|---|
| 3,515,792 | 6/1970 | Deutsch | 84/1.03 |
| 3,981,217 | 9/1976 | Oya | 84/1.03 |
| 4,080,862 | 3/1978 | Hiyoshi et al. | 84/1.01 X |
| 4,082.027 | 4/1978 | Hiyoshi et al. | 84/1.01 |
| 4,114,497 | 9/1978 | Hiyoshi et al. | 84/1.01 X |
| 4,131,049 | 12/1978 | Okumura et al. | 84/1.01 |
| 4,173,164 | 11/1979 | Adachi et al. | 84/1.19 |

*Primary Examiner*—S. J. Witkowski

*Attorney, Agent, or Firm*—Ostrolenk, Faber, Gerb & Soffen

[57] ABSTRACT

An electronic musical instrument is provided with a plurality of wave shape memories storing different musical tone wave shapes of different memory sizes for different tone ranges. The memory for the treble tone is of a small size and that for the bass tone is of a large large size. When a key is operated in the keyboard, a memory corresponding to the tone range to which the operated key belongs is selected and read out. While successfully avoiding economically disadvantageous increase in the memory size of the wave shape memories, beautiful and clear musical tones can be obtained having different tone colors for different tonal pitches just like those generated by natural musical instruments.

13 Claims, 8 Drawing Figures

ELECTRONIC MUSICAL INSTRUMENT OF WAVE MEMORY READING TYPE

BACKGROUND OF THE INVENTION

The present invention relates to an improved electronic musical instrument of a wave memory reading type, and more particularly relates to an improvement in the apparatus for reading out musical tone wave shapes stored in wave shape memories so as to generate musical tones which correspond to operated keys of the keyboard of the electronic musical instruments.

The conventional electronic musical instrument of a wave memory reading type generally includes a keyboard circuit having a plurality of output lines which respectively correspond to a plurality of keys, an address signal generator coupled to the keyboard circuit and generative of address signals when any key in the keyboard is operated, and a wave shape memory storing sample values of a wave shape and outputs a musical tone wave shape signal upon receipt of the address signals passed from the address signal generator. Preferably, the musical tone wave shape signal so obtained is multiplied by an envelope wave shape for generation of a corresponding musical tone. The address signal generator in general includes a frequency information memory generative of different frequency information signals when different keys are operated, and an accumulator which sequentially accumulates the frequency information signals at times determined by given clock pulse signals in order to output accumulated values as address signals for the wave shape memory.

With the above-described construction of the conventional electronic musical instrument of a wave memory reading type, the operation of different keys causes generation of different frequency information signals and, consequently, different series of accumulated values which define different series of address signals for the wave shape memory. Therefore, the speed of aligning the values from the wave shape memory differs from key to key when any key is operated. The combination of the sample values read out of the wave shape memory forms a corresponding musical tone wave shape. That is the musical tone wave shape read out of the wave shape memory differs from key to key when any key is operated.

In this connection, however, it should be noted that the sample values read out from the wave shape memory form part of a single predetermined wave shape which is fixed in advance. Consequently, although a difference in the combination of the sample values read out of the wave shape memory may result in some change in the musical tone wave shape read out of the wave shape memory, the musical tone wave shapes cannot be significantly different from the basic wave shape whose sample values are stored in the wave shape memory. In other words, it is quite impossible with the conventional construction of the electronic musical instrument to generate musical tones having different tone colors for different tonal pitches. Thus, musical tones generated by the conventional electronic musical instruments are quite unlike those generated by natural musical instruments.

In addition, the sampling theorem must be satisfied at reading-out of the wave shape memory as hereinafter explained in more detail. This requirement gives limitation to the number of higher harmonics contained in the musical tone wave shapes read out of the wave shape memory. Due to this limitation, it is difficult to generate musical tones with rich tone colors particularly in the bass range. When the sampling theorem is not satisfied, the generated musical tones contain noises caused by generation of reflected frequency-numbers.

Further, since the frequency-number information memory is required to store frequency-number information corresponding to all keys in the keyboard, it is necessary to use a memory of a large memory size, i.e. a large data storing capacity, which is relatively expensive.

SUMMARY OF THE INVENTION

It is one object of the present invention to provide an electronic musical instrument of a wave memory reading type which is generative of musical tones having different tone colors for different tonal pitches and very close to those generated by natural musical instruments.

It is another object of the present invention to provide an electronic musical instrument of a wave memory reading type which is generative of musical tones having an appropriate number of harmonic tones in accordance with the tone range of the operated key.

It is the other object of the present invention to provide an electronic musical instrument of a wave memory reading type which is generative of clear musical tones including no noises to be caused by presence of reflected frequency-numbers.

It is a further object of the present invention to provide an electronic musical instrument of a wave shape reading type which requires no appreciable increase in memory size for the component memories despite the greatly improved tone generating function.

In accordance with the present invention, the electronic musical instrument includes a keyboard circuit, an address signal generator coupled to the output of the keyboard circuit, a plurality of wave shape memories coupled to the output of the address signal generator and storing different wave shapes, a sound system coupled to the output of the wave shape memories for generation of musical tones, and a wave shape memory selecting circuit coupled to the output of the keyboard circuit and adapted to determine which musical tone wave shape or shapes are to be inputted to the sound system from one or more of the wave shape memories. When a key is operated, the keyboard circuit generates a corresponding tone range information signal and a corresponding note information signal which is received by the address signal generator for generation a series of address signals corresponding to the operated key. Each wave shape memory generates, upon receipt of the series of address signals, a musical tone wave shape to be applied to the sound system for generation of a corresponding musical tone. The wave shape memory selecting circuit fixes musical tone wave shape or shapes to be inputted to the sound system in accordance with the tone range information applied thereto from the keyboard circuit.

In accordance with one preferred aspect of the present invention, the wave shape memory selecting circuit is interposed, in parallel with the address signal generator, between the keyboard circuit and the wave shape memories and, upon receipt of a tone range information, selects at least one corresponding wave shape memory in order to make the same ready for reading-out its stored musical tone wave shape.

In accordance with another aspect of the present invention, a gate circuit is located at the output of each wave shape memory and the wave shape memory selecting circuit is interposed between the keyboard circuit and the gate circuits in order to open, upon receipt of the tone range information signal, at least one corresponding gate circuit.

In accordance with another aspect of the present invention, the keyboard circuit generates a key-on signal whenever a key is operated, the wave shape memories are coupled to the sound system via a common multiplier, an envelope wave shape generator is interposed between the keyboard circuit and the multiplier in order to generate an envelope wave shape upon receipt of the key-on signal, and the musical tone wave shape or shapes are multiplied by the envelope wave shape before being applied to the sound system.

DESCRIPTION OF THE PREFERRED EMBODIMENT

Figure 1:
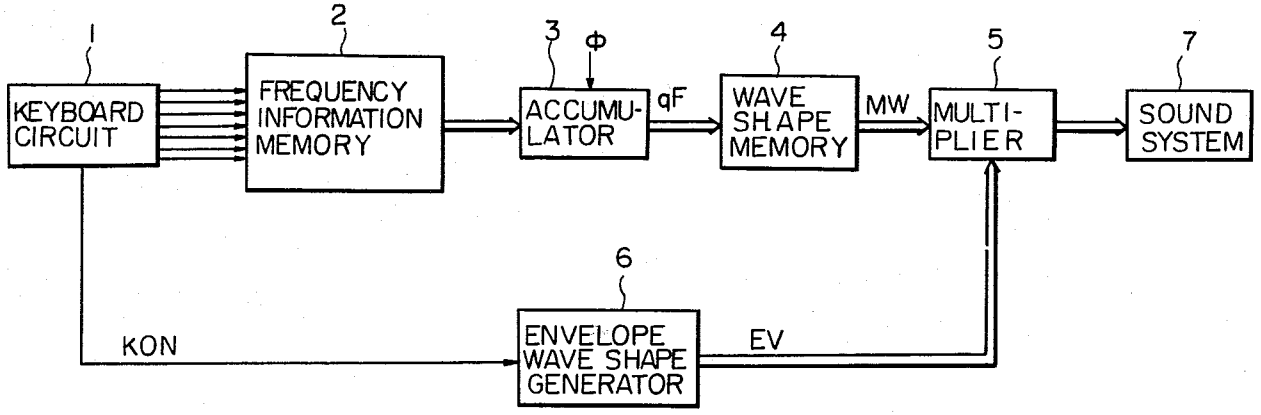
Fig. 1 PRIOR ART
FIG. 1 is a block diagram for showing a typical construction of the conventional electronic musical instrument of a wave memory reading type.

One known construction of an electronic musical instrument of a wave shape reading type is shown in FIG. 1. Keyboard circuit 1 generates a logic value "1" on a respective output line when a corresponding key in the keyboard (not shown) is operated. For the sake of simplicity, the invention is described with respect to a monophonic type instrument. The keyboard circuit 1 is provided with a single key selecting circuit which selects a single key when two or more keys are simultaneously operated. One example of such a single key selecting circuit is disclosed in U.S. Pat. No. 3,981,217 to Oya issued Sept. 21, 1976. The keyboard circuit further generates a key-on signal KON which indicates that at least one of the keys has been operated.

Output lines from the keyboard circuit 1 are coupled to the input of a frequency information memory 2 in which frequency information signals corresponding to the basic frequencies of musical tones to be generated are stored. When a certain key is operated, a frequency information signal F corresponding to the tonal pitch of the operated key is read out of frequency information memory 2.

The output of frequency information memory 2 is coupled to the input of an accumulator 3 which accumulates, upon receipt of clock pulse signals $\phi$ having a constant frequency, the frequency information signals F generated by frequency information memory 2 in order to output a series of sequential accumulated values qF ($q=1, 2, 3, ---$) as "read-out address signals".

The output of accumulator 3 is coupled to the input of a wave shape memory 4. The wave shape memory 4 stores a number of sample values of a musical tone wave shape including a large number of higher harmonic components. As the wave shape memory 4 receives read-out address signals (qF) from the accumulator 3, it sequentially outputs, as a musical tone wave shape MW corresponding to the operated key, sample values stored in the addresses identified by the given read-out address signals.

Figure 2:
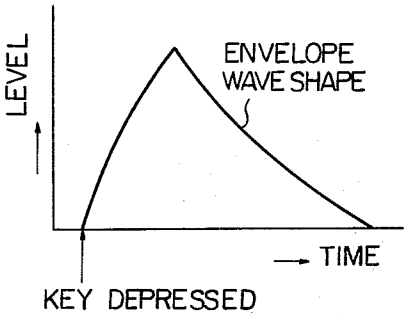
FIG. 2 is a graph for showing a typical example of the envelope wave shape to be multiplied to musical tone wave shapes.

The output of the wave shape memory 4 is coupled to a first input of a multiplier 5 whose second input is coupled to the output of an envelope wave shape generator 6. The envelope wave shape generator 6 serves to impart a proper tone volume envelope to the musical tone wave shape. One example of the envelope wave shape EV to be generated is shown in FIG. 2. Selection of the envelope wave shape EV is carried out by manually operating musical tone selector switches provided on the front panel on the musical instrument. Upon receipt of the key-on signal KON from the keyboard circuit 1, the envelope wave shape generator 6 outputs an envelope wave shape signal EV in order to pass same to the above-described multiplier 5.

The output of multiplier 5 is coupled to a sound system 7 including electric components such as amplifiers and loud speakers. At multiplier 5, the musical tone wave shape signal MW generated by wave shape memory 4 are multiplied by the envelope wave shape signal passed from the envelope wave shape generator 6, respectively, for provision of proper tone volume envelope, and then the multiplied results are passed to the sound system 7 for generation of corresponding musical tones.

As is clear from the foregoing description, the conventional electronic musical instrument of a wave memory reading type comprises, as the major components, a frequency information memory 2 and a wave shape memory 4, the former memory 2 storing frequency information signals F corresponding to the basic frequencies of the respective musical tones to be generated and the latter memory 4 storing sample values of a desired musical tone wave shape. When a certain key is operated on the keyboard, frequency information signals F corresponding to the operated key are read out of frequency information memory 2, the read-out frequency information signals F are sequentially accumulated in order to obtain an accumulated value qF ($q=1, 2, 3, ---$) which serves as an address signal for the wave shape memory 4 and a musical tone wave shape MW corresponding to the operated key is read out from the wave shape memory 4.

As generally mentioned already, the conventional electronic musical instrument of a wave memory reading type having the above-described construction and function is accompanied by the following drawbacks.

(A) The musical tone wave shapes for all the keys in the keyboard range are read out of a single wave shape memory 4. Consequently, when the wave shape to be stored by the wave shape memory 4 is determined, tone colors of the generated musical tones are almost similiar to each other even for different tonal pitches. This is quite unlike the natural musical instruments in which tone colors of the generated musical tones differ as the tonal pitches differ.

(B) When an address signal qF (q=1, 2, 3, - - - ) is used to read the sample value out of the wave shape memory 4, a sampling frequency fϕ is required to satisfy the sampling theorem. Here, the sampling frequency fϕ is an increasing speed of the address signal qF and is proportional to the frequency of the clock pulse signal to be inputted to the accumulator 3. That is, the frequency fh of the highest harmonic component among the all harmonic components contained in the musical tone wave shape MW should be one half of the sampling frequency fϕ or smaller. Consequently, the available content of higher harmonics in the musical tone wave shape to be stored in the wave shape memory 4 is limited by the number of harmonics contained in the musical tone wave shape MW of the highest tonal pitch, the number of the above-described harmonics corresponding to the number of the harmonic tones contained in the generated musical tone of the highest tonal pitch. As a result of this limitation, the number of the higher harmonics contained in the musical tone wave shape MW to be read out from the wave shape memory 4 in accordance with the total pitch of the operated key is limited by the number of the higher harmonics contained in the musical tone wave shape of the highest tonal pitch. For this reason, musical tone wave shapes MW in the bass range lack in the number of the higher harmonics and, therefore, it is impossible for the conventinal electronic musical instrument of a wave memory reading type to generate bass range musical tones of rich tone colors.

When the above-described sampling theorem is not satisfied and the frequency fh of the highest harmonic component contained in the musical tone wave shape MW exceeds one half of the sampling frequency fϕ, the musical tone wave shape MW includes a reflected component of a frequency ($fh-\frac{1}{2}f\phi$). This reflected frequency does not correspond to any harmonic tone of the basic frequency of the musical tone to be generated. Consequently, generation of such reflected frequency results in the generation of undesirable noises in the musical tones to be generated with the result that the tone quality of the latter is seriously damaged.

(C) In the case of the conventional electronic musical instrument of wave memory reading type, it is necessary to employ either one of the following two data storing systems.

In accordance with the first data storing system, different frequency information signals F are stored in the frequency information memory 2 for different keys.

In accordance with the second data storing system, different frequency information signals $F_o$ are stored in the frequency information memory 2 for twelve different tones (C, C#-B) and the twelve frequency information signals $F_o$ are multiplied by the n-th powers of 2 (n=1, 2, 3, - - - ) from octave to octave, respectively, in order to produce by calculation the frequency information signal F corresponding to the operated keys. As a result, the frequency information memory 2 must be provided with a large number of bits, which naturally leads to disadvantage in economy.

A solution to the above-described drawback (B) is found in U.S. Pat. No. 3,515,792, in which the sampling frequency fϕ takes the form of a basic frequency of the musical tone to be generated multiplied by a suitable integer, whereby the reflected frequency corresponds to a harmonic tone of the basic frequency of the musical tone to be generated. This system may be somewhat effective in reducing the degrading influence of the reflected frequency upon the musical tone wave shape MW to be generated. However, this system requires the use of a different sampling frequency fϕ for different tonal pitches. In other words, it is necessary in the construction shown in FIG. 1 that the number of the clock pulse signals ϕ applied to the accumulator 3 be equal to the number of keys on the keyboard. Such an increased number of the clock pulse signals required makes it quite difficult to generate musical tone wave shapes using the time division (multiplex) method.

Figure 3A:
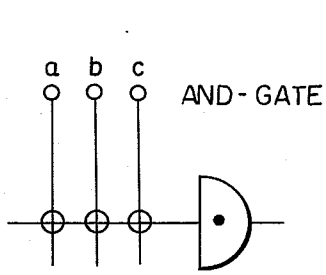
FIGS. 3A and 3B are explanatory drawings for showing AND-gates and OR-gates used in the accompanying drawings.
Figure 3B:
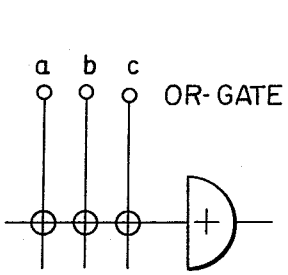

In the following description, an AND-gate is symbolized as shown in FIG. 3A, in which signals a, b and c are applied to an AND-gate. That is, the AND-gate shown in the illustration has three different input terminals each receptive of one of the above-described input signals a, b and c. Likewise, an OR-gate is symbolized as shown in FIG. 3B, in which signals a, b and c are applied to an OR-gate. In other words, the OR-gate shown in the illustration has three different input terminals each receptive of one of the above-described input signals a, b and c.

Figure 4:
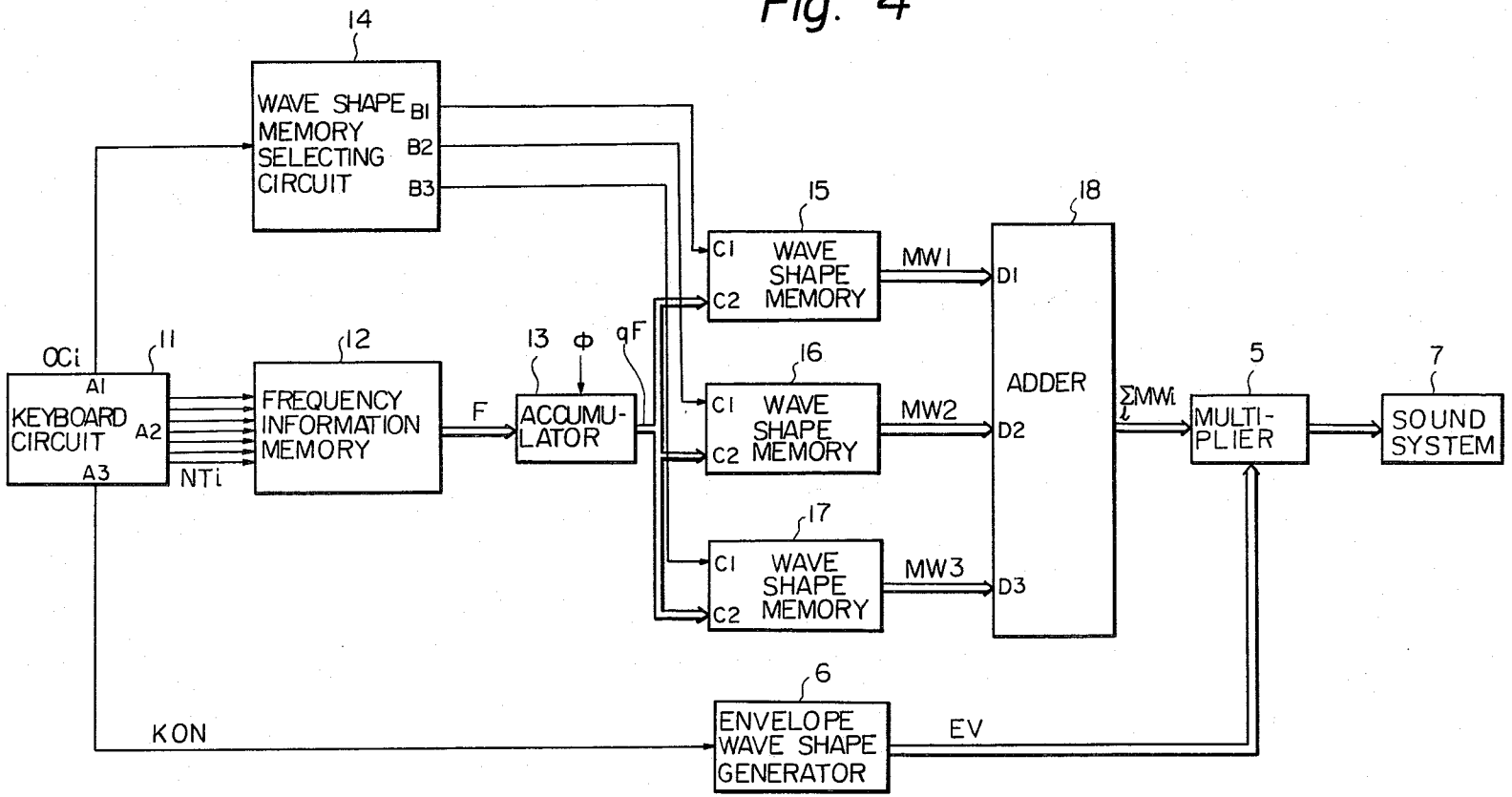
FIG. 4 is a block diagram for showing the construction of the basic embodiment of the electronic musical instrument in accordance with the present invention.

A basic embodiment of the electronic musical instrument in accordance with the present invention is shown in FIG. 4, in which it is assumed that the musical instrument is provided with 36 keys over 3 octaves, and, for the sake of simplicity of explanation, is of a monophonic type.

A first output A1 of a keyboard circuit 11 is coupled to the input of a wave shape memory selecting circuit 14, a second output (a multiline output) A2 of the keyboard circuit 11 is coupled to the input of a frequency information memory 12 and a third output A3 of the keyboard circuit 11 is coupled to the input terminal of an envelope wave generator 6.

When a given key is operated, keyboard circuit 11 generates an octave information signal OCi (i=1, 2, 3, - - - ), corresponding to the octave range to which the operated key belongs, on first output A1. Concurrently, circuit 11 generates both a note information signal NTi (i=1, 2, 3, - - - ) corresponding to the note name of the operated key, on second output A2 and a key-on signal KON, which designates that a key is operated in the keyboard, on third output A3.

Figure 5:
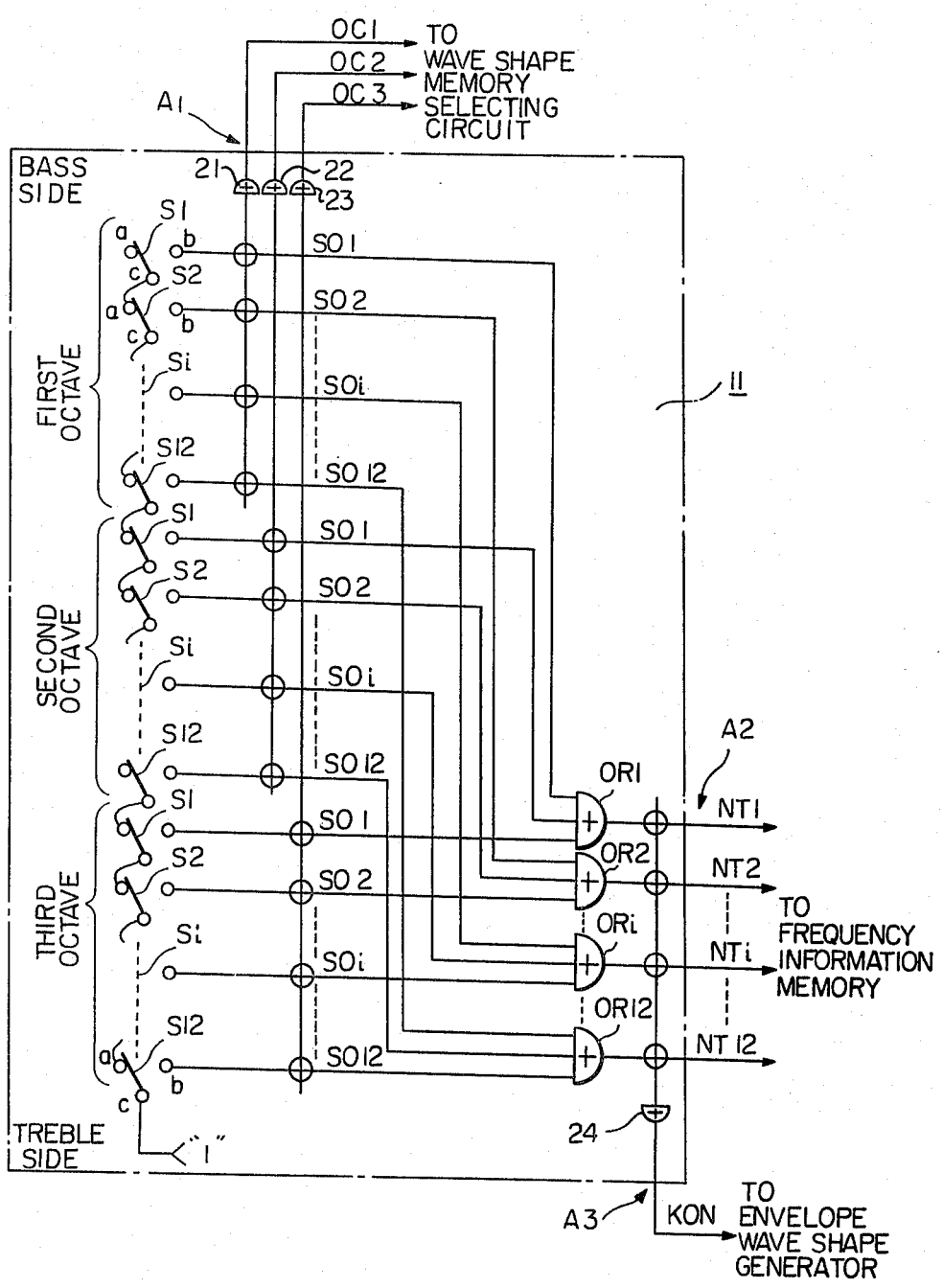
FIG. 5 is a circuit diagram of one example of the keyboard circuit having single tone selecting function and preferably usable for the electronic musical instrument shown in FIG. 4.

One embodiment of the above-described keyboard circuit 11 is shown in FIG. 5, in which twelve sets of key switches S1 to S12 are provided for each of the three octaves corresponding to the first to twelfth tones in each octave. Here, the first octave corresponds to the bass range and the third octave corresponds to the treble range.

A logic value "1" is applied to the movable contact c of the key switch S12 corresponding to the twelfth tone in the third octave. The fixed contact a of each key switch is coupled to the movable contact c of that key switch which is located directly on its lower tonal pitch side by a respective connector lead 50.

Assuming that a key corresponding to the first tone in the first octave is operated, the movable contact c of the key switch S1 is brought into contact with the fixed contact b. Thus, the logic value "1" applied to the movable contact c of the key switch S12 in the third octave appears on the output line SO1 of the key switch S1 in the first octave.

The key switches Si of this keyboard circuit 11 are coupled to each other in such an arrangement as to single out a single key when two or more keys are operated simultaneously. For example, if the two keys corresponding to the first and second tone key switches S1 and S2 in the first octave are simultaneously operated such that the movable contacts c of the two key switches are brought into contact with their associated fixed contacts b, a logic value "1" will appear on the output line SO2 of the second tone key switch S2. Since the movable contact c of the switch S2 in the first octave is disconnected from its fixed contact a, the logic value "1" applied to the movable contact c of the twelfth tone key switch S12 in the third octave is not applied to the movable contact c of the switch S1 in the first octave. Consequently, despite of the connection between the contacts c and b of the first switch S1, the logic value "1" does not appear on the output line SO1 of the first tone key switch S1. As is clear from the foregoing description, when two or more keys are operated simultaneously, only that key switch of the highest tonal pitch generates a logic value "1" on its output contact b.

The output lines SO1 to SO12 of the key switches S1 to S12 in the first octave are coupled to the input of an OR-gate 21, the output lines SO1 to SO12 of the key switches S1 to S12 in the second octave are coupled to the input of an OR-gate 22, and the output lines SO1 to SO12 of the key switches S1 to S12 in the third octave are coupled to the input of an OR-gate 23. The output of OR-gates 21, 22 and 23 define the A1 output of the keyboard circuit 11 shown in FIG. 4 and are coupled to the input of wave shape memory selecting circuit 14.

Thus, when any key in the first octave is operated, a logic value "1" appears on one of the output lines SO1 to SO12 of the key switches S1 to S12 in the first octave, and appears, via the OR-gate 21, at the output A1 as the first octave information signal OC 1. Similarly, when any key in the second octave is operated, a logic value "1" appears on one of the output lines SO1 to SO12 of the key switches S1 to S12 in the second octave, and appears, via the OR-gate 22, at the output A1 as the second octave information signal OC2 from the keyboard circuit 11. Finally, when any key in the third octave is operated and a logic value "1" appears on one of the output lines SO1 to SO12 of the key switches S1 to S12 in the third octave, it is applied, via the OR-gate 23, to output A1 as the third octave information OC3 from the keyboard circuit 11.

The three sets of output lines SO1 of the first key switches S1 in the three octaves are coupled to the input of a common OR-gate OR1, and the three sets of output lines SO2 of the second key switches S2 in the three octaves are coupled to the input of a common OR-gate OR2. Generally, the three sets of output lines SOi of the i-th key switches Si (i=1, 2, 3, - - - ) in the three octaves are coupled to the input of a common OR-gate ORi. The outputs of the OR-gates OR1 to OR12 correspond to the output terminal A2 of the keyboard circuit 11 shown in FIG. 4 and are coupled to the input of the frequency information memory 12.

Thus, when any key corresponding to the first note in any octave is operated, a logic value "1" appears on the output line SO1 of the corresponding first tone key switch S1, and is applied to OR-gate OR1 causing keyboard circuit 11 to generate the first note information signal NT1. Likewise, when any key corresponding to the second note in any octave is operated, a logic value "1" appears on the output line SO2 of the corresponding second tone key switch S1, and is applied to the OR-gate OR2 causing key board circuit 11 to generate the second note information signal NT2. Generally, when any key corresponding to the i-th note in any octave is operated and a logic value "1" appears on the output line SOi of the corresponding i-th key switch Si, it is applied to the OR-gate ORi and keyboard circuit 11 generates the i-th note information signal NTi.

The output of the twelve sets of OR-gates OR1 through OR12 are coupled to a common OR-gate 24. The output of OR-gate 24 corresponds to output terminal A3 of the keyboard circuit 11 shown in FIG. 4.

Thus, when a key is operated and an i-th note information signal NTi, which is given in the form of a logic value "1", is generated by the i-th OR-gate ORi, and is passed by OR-gate 24 as a key-on signal KON which is also given in the form of a logic value "1".

As is clear from the foregoing description, keyboard circuit 11 serves to generate an octave information signal OCi (i=1, 2, 3, - - - ), designating the octave to which the operated key belongs, a note information signal NTi (i=1, 2, 3, - - - ), designating the note of the operated key, and a key-on signal KON designating operation on a key whenever any given key is operated.

Referring again to FIG. 4, one output B1 of the wave shape memory selecting circuit 14 is coupled to the control terminal C1 of first wave shape memory 15, another output B2 thereof is coupled to control terminal C1 of second wave shape memory 16, and a third output B3 thereof is coupled to the control terminal C1 of third wave shape memory 17. Each wave shape memories 15, 16 and 17 is placed in a state suited for reading-out when a logic value "1" is inputted to its control terminal C1.

The first wave shape memory 15 is provided with 64 addresses (i.e. 64 sample values), the second wave shape memory 16 is provided with 32 addresses, and the third wave shape memory 17 is provided with 16 addresses. That is, the memory size, i.e. the data storing capacity, of the second wave shape memory 16 is one half of that of the first wave shape memory 15 whereas the memory size of the third wave shape memory 17 is one half of that of the second wave shape memory 16.

The wave shape memory selecting circuit 14 serves to determine which wave shape memory 15, 16 or 17 will be placed in a state suited for reading-out upon receipt of the octave information signal OCi (i=1, 2, 3 ) at any given instant. That is, when the keyboard circuit 11 generates the octave information signal OC1 indicating that the operated key is in the first octave, wave shape memory selecting circuit 14 generates a logic value "1" on its the first output terminal B1 placing the first wave shape memory 15 in a condition for reading-out. When the keyboard circuit 11 generates the octave information signal OC2 designating that the operated key is in the second octave, wave shape memory selecting circuit 14 generates a logic value "1" on its second output terminal B2 placing the second wave shape memory 16 in a condition for reading-out. Finally, when keyboard circuit 11 generates the octave information signal OC3 indicating that the operated key is in the third octave, wave shape memory selecting circuit 14 generates a logic value "1" on its third output terminal B3 placing the third wave shape memory 17 in a condition for reading out. Each of the octave information signals OC1–OC3 serves as an enabling signal for its corresponding wave shape memory 15, 16, 17.

The first wave shape memory 15 stores sample values of a wave shape including proper higher harmonic components so that the musical tone wave shapes MW1 read out of the first wave shape memory 15 satisfy the sampling theorem with respect to the musical tones in the first octave. The second wave shape memory 16 stores sample values of a wave shape including proper higher harmonic components so that the musical tone wave shapes MW2 read out of the second wave shape memory 16 satisfy the sampling theorem with respect to the musical tones in the second octave. Finally, the third wave shape memory 17 stores sample values of a wave shape including proper higher harmonic components so that the musical tone wave shapes MW3 read out of the third wave shape memory 17 satisfy the sampling theorem with respect to the musical tones in the third octave.

The output of frequency information memory 12 is coupled, via an accumulator 13, to the address input terminals C2 of the three wave shape memories 15, 16 and 17, respectively. Here, the frequency memory 12 stores twelve types of frequency information signals F corresponding to the twelve notes in each octave and, upon receipt of a given note information signal NTi (i=1, 2, 3, - - - ) from keyboard circuit 11, generates a frequency information signal F corresponding thereto. Upon receipt of clock pulse signals $\phi$, the accumulator 13 accumulates the frequency information signal F at its output in order to generate progressing accumulated values qF (q=1, 2, 3, - - - ) in the form of 6 bits address signals.

Figure 6:
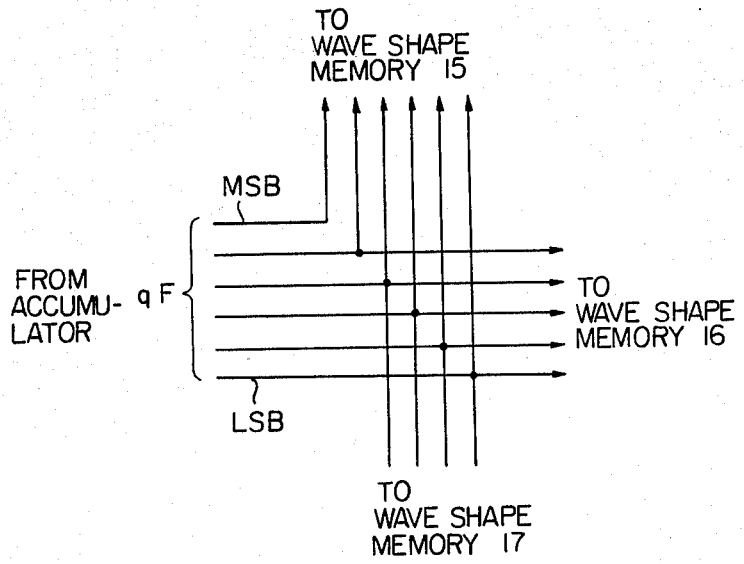
FIG. 6 is a circuit diagram of a modified embodiment of the accumulator and its related parts usable for the electronic musical instrument shown in FIG. 4.

As shown in FIG. 6, all 6 bits of each address signal (qF) are applied to the address input C2 of the first wave shape memory 15, while the lowest 5 bits of each 6-bit address signal are applied to the address input C2 of the second wave shape memory 16, and only the lowest 4 bits of each 6-bit address signal are passed to the address input C3 of the third wave shape memory 17.

In the case of the illustrated embodiment, the frequency information memory 12 and the accumulator 13 together form an address signal generator.

The output of the first wave shape memory 15 is coupled to the first input D1 of an adder 18, the output of the second wave shape memory 16 is coupled to the second input D2 of the adder 18, and the output of the third wave shape memory 17 is coupled to the third input D3 of the adder 18.

The output of adder 18 is coupled to one input of a multiplier 5 whose other input is coupled to the output of an envelope wave shape generator 6. The output of the multiplier 5 is coupled to a sound system 7.

Operation of the above-described electronic musical instrument is as follows.

When a key is depressed, keyboard circuit 11 generates on output A1, an octave information signal OC1 (i=1, 2, 3) indicating the octave to which the depressed key belongs. Upon receipt of this octave information signal OCi wave shape memory selecting circuit 14 generates a logic value "1" on at least one of the three output terminals B1, B2 and B3, thereby placing at least one of the three wave shape memories 15, 16 and 17 ready for reading-out.

Concurrently, a note information signal NTi (i=1, 2, 3, - - - ) is generated on the second output A2 of keyboard circuit 11 and applied to frequency information memory 12. In response, frequency information memory 12 generates frequency information signals F corresponding to the note of the depressed key. These signals are repeatedly accumulated in the accumulator 13 at the timing of the clock pulse signals$\phi$ in order to obtain sequentially increasing accumulated values qF. As hereinbefore described, an accumulated values qF take the form of a 6-bit word. All the bits of the accumulated value qF are applied to the first wave shape memory 15 as an address signal, the lowest 5 bits of the accumulated value qF are applied to the second wave shape memory 16 as an address signal, and the lowest 4 bits of the accumulated value qF are applied to the third wave shape memory 17 as an address signal. Consequently, those ones of the three wave shape memories 15, 16 and 17 which are ready for reading-out output a musical tone wave shape MWi (i=1, 2, 3) determined by the corresponding address signals applied thereto.

The first wave shape memory 15 has 64 addresses and is accessed by the 6 bits of the accumulated value qF from the accumulator 13. The second wave shape memory 16 has 32 addresses and is accessed by the lowest 5 bits of the accumulated value qF. The third wave shape memory 17 has 16 addresses and is accessed by the lowest 4 bits of the accumulated value qF.

As the address shifting speed (i.e. the rate at which the accumulated value qF increases) is common to all of the three wave shape memories 15, 16 and 17, the period of the musical tone wave shapes MV1 generated by the first wave shape memory 15 is twice of that of the musical tone wave shapes MV2 outputted from the second wave shape memory 16, and is four times of that of the musical tone wave shapes MV3 outputted from the third wave shape memory 17. Consequently, during a time interval during which the first wave shape memory 15 is read out once to output the musical tone wave shape MV1 over one period, the second wave shape memory 16 is read out twice to output the musical tone wave shape MV2 over two periods, and the third wave shape memory 17 is read out four times to output the musical tone wave shape MV3 over four periods.

As is clear from the foregoing description, the wave shape memories 15, 16 and 17 generate, upon receipt of the address signal qF generated by accumulator 13, musical tone wave shapes MWi (i=1, 2, 3), respectively, whose frequency ratio is 1:2:4. In the case of this embodiment, however, any one of the three wave shape memories 15, 16 and 17 is made ready for reading-out by operation of the wave shape memory selecting circuit 14. Therefore, when twelve different frequency information signals F corresponding to the notes in each octave are stored in the frequency information memory 12, it is possible to obtain musical tone wave shapes MWi over three octaves, i.e. 36 keys.

The read-out musical tone wave shape MWi is passed to the first input of the multiplier 5 via the adder 18. The envelope wave shape generator 6 generates the envelope wave shape EV upon receipt of the key-on signal KON from the keyboard circuit 11, which is passed to the second input of the multiplier 5. Thus, the musical tone wave shape MWi from the adder 18 is multiplied by the envelope wave shape EV and passed to the sound system for generation of a corresponding musical tone.

By way of example, it may be assumed that a key of the first note in the first octave is depressed. The keyboard circuit 11 then outputs an octave information signal OC1 on its first output A1 which is applied to the wave shape memory selecting circuit 14. As a result, the wave shape memory selecting circuit 14 generates a logic value "1" on its first output terminal B1, which is applied to control input terminal C1 of the first wave shape memory 15 in order to make is ready for reading-out.

Concurrently, a note information signal NT1 is generated on the second output A2 of the keyboard circuit 11 and applied to the frequency information memory 12 causing memory 12 to generate the frequency information signal F1. This frequency information signal is repetitively accumulated at the accumulator 13 at timing determined by the clock pulse signals $\phi$, causing accumulator 13 to output an accumulated value qF1 (q=1, 2, 3, - - - ) as a progressing 6-bit address signal. The first wave shape memory 15 (now ready for reading-out) receives this signal at its address input C2 and outputs its stored sample values representing the desired musical tone wave shape MW1.

This musical tone wave shape MW1 is passed to the input D1 of the adder 18. In the present example, a 5-bit address signal is applied to the second wave shape memory 16 and a 4-bit address signal is applied to the third wave shape memory 17. However, since the logic value "1" is not applied to the control inputs C1 of the second and thrid wave shape memories 16 and 17, these memories 16 and 17 do not output a musical tone wave shape. Therefore, the adder 18 outputs the musical tone wave shape MW1 only. This wave shape is multiplied at the multiplier 5 by the envelope wave shape EV from the envelope wave shape generator 6 and passed to the sound system 7 for generation of a corresponding musical tone.

In accordance with the above-described embodiment of the present invention, wave shape memories storing different wave shapes are provided for different octaves in order to successfully afford different tone colors for different tonal pitch ranges. In addition, a wave shape memory is provided for each octave and musical tone wave shapes are outputted in such a manner as to satisfy the sampling theorem in order to generate appropriate and beautiful musical tones for respective octaves. For example, musical tones with more harmonic tones are generated for the bass range whereas musical tones with fewer harmonic tones are generated for the treble range. This is quite similar to the tendency of effective number of harmonic components in musical tones generated by natural musical instruments. In other words, the electronic musical instrument in accordance with the present invention assures generation of musical tones having tone colors very close to those of musical tones generated by natural musical instruments.

In accordance with the above-described embodiment of the present invention, further, wave shape memories of different memory sizes, i.e. data storing capacities, are used for different octaves. As a result of to this design, musical tones over all octaves, i.e. all keys in the keyboard, can be generated by storing in the frequency information memory only twelve sets of frequency information signals corresponding to the notes in an octave. The sampling theorem is reliably satisfied for respective octaves in order to generate clear musical tones without inclusion of reflected frequency noises.

The memory sizes of the wave shape memories are so varied that the memory size of a wave shape memory for an octave is one half of that of a wave shape memory for the next lower octave. Therefore, when the memory size of the wave shape memory for the lowest octave is designated by N, the following relationship can be satisfied;

$$N+N/2+N/4+ - - - <2N$$

Thus, the memory size required for the electronic musical instrument in accordance with the present invention at most doubles that required for the conventional electronic musical instruments employing a single memory for all over the note range.

In the case of the embodiment shown in FIG. 4, different wave shape memories are provided for different octaves and a musical tone wave shape is read out from a wave shape memory corresponding to the octave to which the operated key belongs. It is also, possible, however, to read out a plurality of musical tone wave shapes from a plurality of wave shape memories in accordance with the octave to which the operated key belongs.

Figure 7:
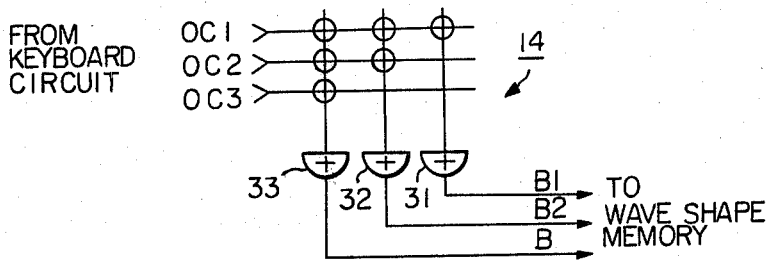
FIG. 7 is a circuit diagram of a modified embodiment of the wave shape memory selecting circuit usable for the electronic musical instrument shown in FIG. 4.

An embodiment of the wave shape memory selecting circuit 14 is shown in FIG. 7. The output line for the first octave information signal OC1 is coupled, via OR-gates, 31, 32 and 33, to the three output terminals B1, B2 and B3 of the wave shape memory selecting circuit 14, respectively, the output line for the second octave information signal OC2 is coupled, via the OR-gates 32 and 33, to the two output terminals B2 and B3, and the output line for the third octave information signal OC3 is coupled, via the OR-gate 33, to the output terminal B3.

when the first octave information OC1 is generated by from keyboard circuit 11, a logic value "1" appears at all three output terminals B1, B2 and B3 of the wave shape memory selecting circuit 14 in order to make the three wave shape memories ready for reading-out. When the second octave information signal OC2 is generated by keyboard 11, a logic value "1" appears at both the output terminals B2 and B3 of the wave shape memory selecting circuit 14 in order to make the two wave shape memories 16 and 17 ready for reading-out. Finally, when the third octave information signal OC3 is generated by keyboard circuit 11, a logic value "1" appears at the output terminal B3 of the wave shape memory circuit 14 in order to make the wave shape memory 17 ready for reading-out.

As the accumulated value qF (q=1, 2, 3, - - - ) is received from the accumulator 13, those wave shape memories 15–17 which receive a logic value "1" on their control input C1 output musical tone wave shapes MWi. The musical tone wave shapes MWi are then added by the adder 18 in order to form a sum $$\sum_i MWi,$$

which is multiplied by the envelope wave shape EV at the multiplier 18 and passed to the second system 7 for generation of a corresponding musical tone.

For example, it is assumed that the first octave information OC1 signal is generated by keyboard circuit 11, a logic value "1" appears at each of the output terminals B1, B2 and B3 of the wave shape memory selecting circuit 14 and the wave shape memories 15, 16 and 17 are all made ready for reading-out. Upon receipt of a 6-bit address signal from the accumulator 13, the first wave shape memory 15 outputs a musical tone wave shape MW1 which is applied to the input D1 of the adder 18. Upon receipt of a 5-bit address signal from the accumulator 13, the second wave shape memory 16 outputs a musical tone wave shape MW2 which is applied to the input D2 of the adder 18. Upon receipt of a 4-bit address signal from the accumulator 13, the third wave shape memory 17 generates a musical tone wave shape MW3 which is applied to the input D3 of the adder 18. The three musical tone wave shapes MW1 through MW3 are then added by the adder 18 which generates an output signal indicative of the sum (MW1+MW2+MW3). This signal is applied to the multiplier 5 for multiplication by the envelope wave shape EV and the resultant signal is applied to the sound system 7 for generation of a corresponding musical tone. When the second octave information signal OC2 is generated by the keyboard circuit 11, a signal indicative of the sum (MW2+MW3) is generated by adder 18. Finally, when the third octave information signal OC3 is generated by keyboard circuit 11, a signal indicative of the musical tone wave shape MW3 is generated by adder 18.

In the case of the above-described embodiment in which a plurality of musical tone wave shapes are read out from a plurality of wave shape memories in accordance with the octave of the operated key, suitable weighting can be applied to the respective musical tone wave shapes before they are added by adder 18. That is, the musical tone wave shapes MWi may be multiplied by time-functional parameter signals Pi(t), respectively, before they are added by adder 18 in order to generate musical tones having a wide variety of tone colors.

In the foregoing description, an octave is regarded as a tone range. However, the present invention is well applicable to cases in which tone ranges other than octaves are employed. Further, although the foregoing description is based on an assumption that the electronic musical instrument is provided with 36 keys arranged over three octaves, the present invention is well applicable to electronic musical instruments having more keys arranged over four or more octaves.

In the case of the construction shown in FIG. 4, the three sets of outputs B1, B2 and B3 of the wave shape memory selecting circuit 14 are coupled to the control terminals C1 of the respective wave shape memories 15, 16 and 17 in order to make one wave shape memory ready for reading-out. It is possible to include gate circuits at the output of wave shape memories 15, 16 and 17, the operation of which gate circuits are controlled by the wave shape selecting circuit 14.

In accordance with the present invention, it is possible to obtain musical tones having different tone colors for different tonal pitch ranges. Since the sampling theorem is reliably satisfied for each tone range, musical tones with more harmonic tones are obtained for the bass range whereas musical tones with less harmonic tones are obtained for the treble range. Further, since the generated musical tones include no noise caused by inclusion of reflected frequencies, it is possible to produce very clear musical tones. When compared with the conventional electronic musical instruments, increase in the required memory size is not appreciable despite the greatly improved tone generating function.

We claim:

1. An electronic musical instrument, comprising:

(A) a keyboard including n sets of keys, n being an integer greater than 1, each of said n sets of keys including a plurality of keys and defining a unique tone range;

(B) keyboard circuit means for generating, responsive to the operation of any one of said keys:

(1) a tone range information signal indicating that particular set of keys in which said key being operated is located; and (2) a note information signal indicating which specific key in said particular set of keys is being operated;

(C) address signal generator means responsive to said note information signal for generating a series of address signals corresponding to said key being operated;

(D) a plurality of wave shape memories each responsive to said address signals and each generating a musical tone wave shape unique thereto upon receipt of both said series of address signals and an enabling signal applied thereto;

(E) wave shape memory selecting circuit means for applying enabling signals to selected ones of said wave shape memory means as determined by said tone range information signal; and (F) sound system means responsive to the musical tone wave shapes generated by said wave shape memories for generating an audio signal determined thereby.

2. An electronic musical instrument as claimed in claim 1, wherein said keyboard circuit means also generates a key-on signal responsive to the operation of each of said keys and wherein said instrument further comprises:

a multiplier interposed between said wave shape memories and said sound system means; and an envelope wave shape memory interposed between said keyboard circuit means and said multiplier, said envelope wave shape memory applying an envelope wave shape to said multiplier responsive to the generation of said key-on signal.

3. An electronic musical instrument as claimed in claim 1, in which said keyboard circuit means includes a single key selecting circuit which singles out a key when two or more keys are operated simultaneously.

4. An electronic musical instrument as claimed in claim 1, in which said address signal generator means includes;

a frequency information memory for generating frequency information signals upon receipt of said note information signals; and an accumulator for accumulating said frequency information signals at instances determined by a series of clock pulse signals and for generating output signals indicative of the accumulated values, said output signals defining said address signals.

5. An electronic musical instrument as claimed in claim 1, in which there are n said wave shape memories, each of said n wave shape memories corresponding to a different one of said tone ranges.

6. An electronic musical instrument as claimed in claim 1, wherein each of said wave shape memories are different from each other in memory size.

7. An electronic musical instrument as claimed in claims 1, 5 or 6, wherein different wave shape memories are provided for different octaves.

8. An electronic musical instrument as claimed in claim 7, wherein:

the memory size of a wave shape memory for each octave is one half of that of a wave shape memory for the next lower octave; and each of said address signals comprises a plurality of information bits, a different set of said bits being applied to each of said wave shape memories.

9. An electronic musical instrument as claimed in claim 1, wherein said wave shape memory selecting circuit means is provided with a plurality of output terminals each of which is coupled to a control input terminal of a different wave shape memory and wherein said wave shape memory selecting circuit means generates one said enabling signal on only one of its outputs at any given time wherein only one of said wave shape memories is enabled at any time.

10. An electronic musical instrument as claimed in claim 1, wherein:

each of said wave shape memories includes a control input on which it receives said enabling signals;

said wave shape memory selecting circuit means is provided with a plurality of output terminals, each of said output terminals being coupled to the control input terminal of two or more different wave shape memories whereby two or more of said wave shape memories are simultaneously enabled by said wave shape memory selecting circuit each time it generates an enabling signal on one of its outputs; and an adder is interposed between said wave shape memories and said sound system means.

11. An electronic musical instrument, comprising:

a keyboard including n sets of keys, n being an integer greater than 1, each of said n sets of keys including a plurality of keys and defining a unique tone range;

(B) keyboard circuit means for generating, responsive to the operation of any one of said keys:

(1) a tone range information signal indicating that particular set of keys in which said key being operated is located; and (2) a note information signal indicating which specific key in said particular set of keys is being operated;

(C) address signal generator means responsive to said note information signal for generating a series of address signals corresponding to said key being operated;

(D) a plurality of wave shape memories, each of said wave shape memories generating a musical tone wave shape unique thereto responsive to the generation of said series of address signals;

(E) a plurality of gate circuits equal in number to the number of said wave shape memories, each of said gate circuits receiving the musical tone wave shape generated by a respective one of said wave shape memories;

(F) wave shape memory selecting circuit means for applying enabling signals to selected ones of said gate circuits as determined by said tone range information signal, those gate circuits receiving said enabling signals passing said musical tone wave shape applied thereto; and (G) sound system means responsive to the musical tone wave shapes passed by said gate circuits for generating an audio signal determined thereby.

12. An electronic musical instrument as claimed in claim 11, wherein said wave shape memory selecting circuit means includes a plurality of output terminals equal in number to the number of said gate circuits, each of said output terminals being coupled to a respective one of said gate circuits, said wave shape memory selecting circuit means applying an enabling signal to only one of said output signals at any given instant whereby only one of said gate circuits passes said musical tone wave shape applied thereto at any given instant.

13. An electronic musical instrument as claimed in claim 11, wherein said wave shape memory selecting circuit means comprises a plurality of output terminals, each of said output terminals being coupled to a different set of said gate circuits, each set of said gate circuits including two or more gate circuits whereby two or more of said gate circuits are enabled whenever said wave shape memory selecting circuit means generates an enabling signal on one of its outputs, said electronic musical instrument further including an adder interposed between said gate circuits and said sound system means.

* * * * *